US008791347B1

(12) United States Patent
Christian

(10) Patent No.: US 8,791,347 B1
(45) Date of Patent: Jul. 29, 2014

(54) STAVE PERCUSSION DRUM

(71) Applicant: Joseph B. Christian, Philpot, KY (US)

(72) Inventor: Joseph B. Christian, Philpot, KY (US)

( * ) Notice: Subject to any disclaimer, the term of this patent is extended or adjusted under 35 U.S.C. 154(b) by 0 days.

(21) Appl. No.: 13/845,200

(22) Filed: Mar. 18, 2013

(51) Int. Cl.
*G10D 13/02* (2006.01)

(52) U.S. Cl.
USPC ..... 84/411 R

(58) Field of Classification Search
USPC ..... 84/411 R, 419, 421
See application file for complete search history.

(56) References Cited

U.S. PATENT DOCUMENTS

| | | | | |
|---|---|---|---|---|
| 4,522,006 | A | 6/1985 | Plikuhn | |
| 7,446,250 | B1 * | 11/2008 | van der Meulen | 84/411 R |
| 2013/0055878 | A1 * | 3/2013 | Cox, Jr. | 84/411 R |

OTHER PUBLICATIONS

Jon Cohan, Chris Brady & Craftsmen Snare Drums Reviewed!, Jun./Jul. 2000 issue of Drum! Magazine.

* cited by examiner

*Primary Examiner* — Kimberly Lockett
(74) *Attorney, Agent, or Firm* — Camoriano and Associates

(57) ABSTRACT

A percussion drum including a plurality of vertical staves held together by mechanically interlocking joints on the side edges of the staves.

8 Claims, 4 Drawing Sheets

STAVE PERCUSSION DRUM

BACKGROUND

Stave percussion drums are known in the musical instrument industry. In order to manufacture these drums, flat staves are glued together to form a rough cylinder, and then the cylinder is turned on a lathe to give it a circular cross-section on its inner and outer surfaces. Then top and bottom drum heads are installed using a tensioning system, which presses the top and bottom drum heads against the top and bottom edges of the staves.

SUMMARY

The present invention improves over the known stave percussion drums. It uses a more efficient manufacturing method and produces a drum that does not have glued joints between the staves, thereby producing a better quality sound.

In the present invention, the staves are not glued together but instead are held together by dovetail joints or other similar wood joints that prevent the staves from separating from each other in the horizontal direction without the need for glue. This produces a better sound than the drums with glued joints, because there are no strips of glue to dampen the sound and interfere with the resonance of the drum.

In addition, the staves are cut with radiused inner and outer surfaces before assembly, so no turning is required to form smooth, circular cross-section inner and outer surfaces once the staves are assembled together.

DESCRIPTION

Figure 1:
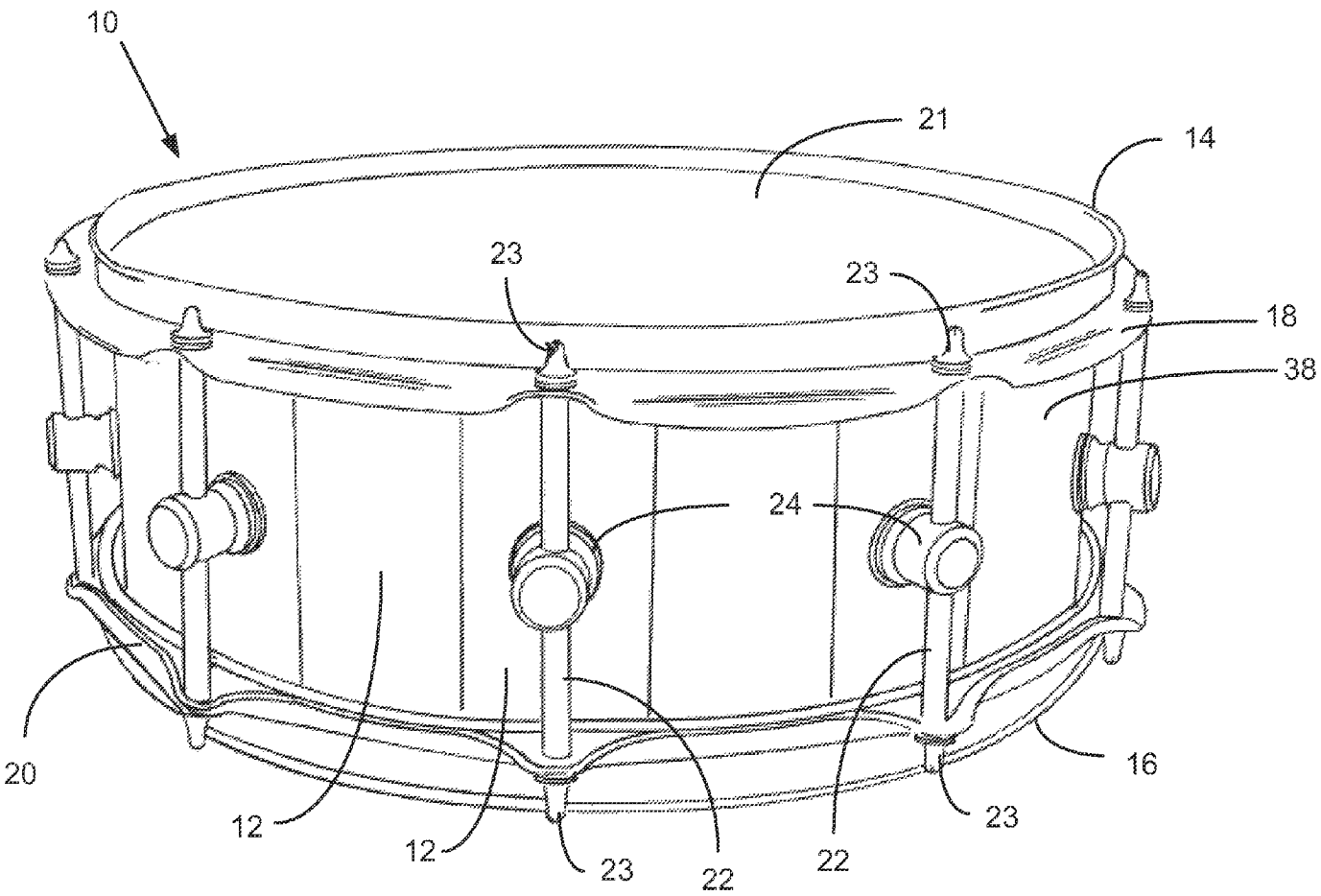
FIG. 1 is a perspective view of a stave percussion drum made in accordance with the present invention.

FIG. 1 shows a stave percussion drum 10. This drum 10 includes a plurality of mechanically interlocking staves 12, which form a cylindrical body 38, which is sandwiched between a top drum hoop 14 and a bottom drum hoop 16.

The hardware that is used on this drum 10 is standard drum hardware. Each of the top and bottom drum hoops 14, 16 defines a circumferential flange, 18, 20 respectively. Top and bottom drum heads, each including a thin sheet of material 21 stretched across a ring (not shown), are secured at the top and bottom edges of the cylindrical body 13, in the standard, known manner, being trapped between the respective hoop

14, 16 and the respective edge of the cylindrical body 13. The thin sheet material of the drum head 21 vibrates when it is hit to make a drum sound.

A plurality of upper and lower tension rods 22 extend into openings in lugs 24, which are placed evenly around the circumference of the cylindrical body 13. Each pair of upper and lower tension rods 22 is secured to each other by a set screw (not shown), which extends through the lug 24 and through aligned holes in the upper and lower tension rods 22. The tension rods 22 are tubular and have threads on their inner surface. The upper tension rods 22 receive bolts 23 at their upper ends, and the lower tension rods 22 receive bolts 23 at their lower ends. The bolts 23 have flanged heads, which press the respective hoop 14, 16 toward the respective lug 24 as the bolts 23 are threaded into their respective tension rods 22.

The lugs 24 are installed by drilling a hole through the respective stave 12, inserting the lug 24 through the drilled hole, and securing the lug 24 to the stave 12 by threading a nut (not shown) onto the back side of the lug 24.

Figure 2:
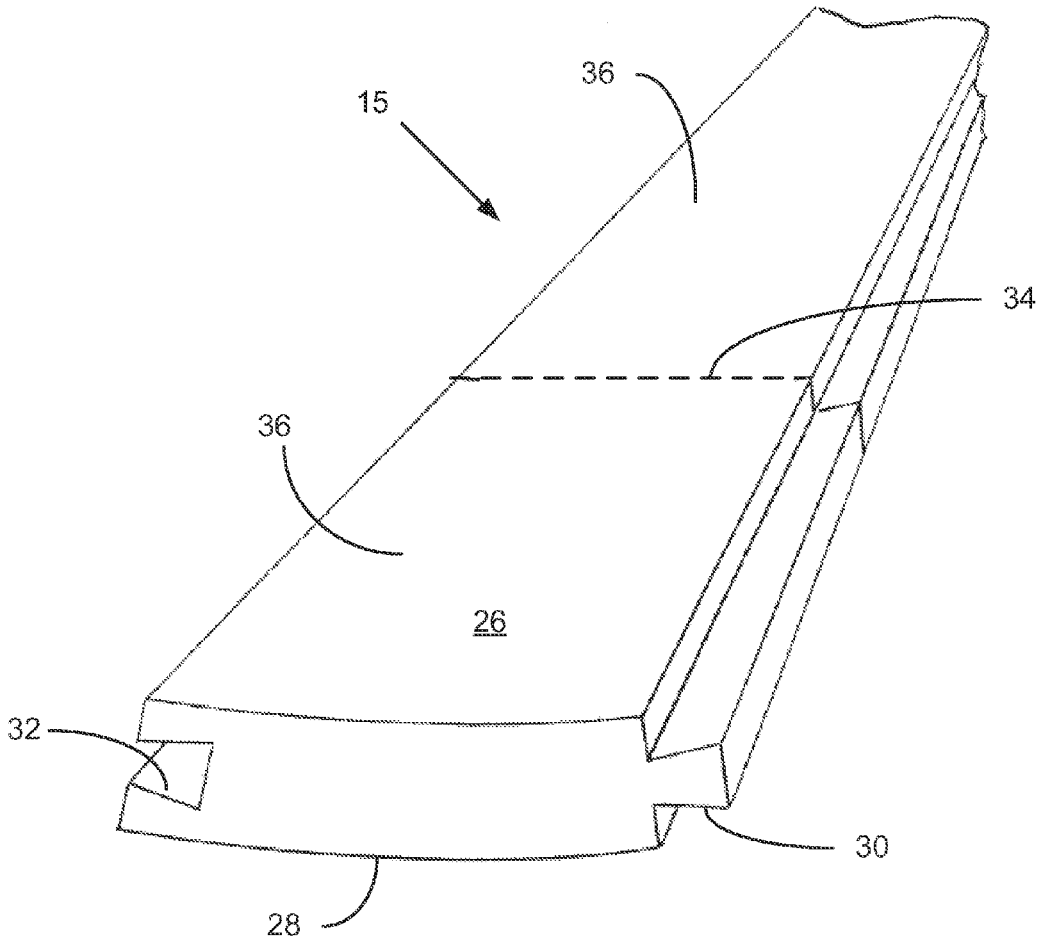
FIG. 2 is a perspective view of a length of lumber after it has been radiused on the inside and outside surfaces and after the longitudinal side edges have been dove-tailed, with a dotted line showing where the length of lumber may be cut into sections which will be assembled to make the drum of FIG. 1.
Figure 3:
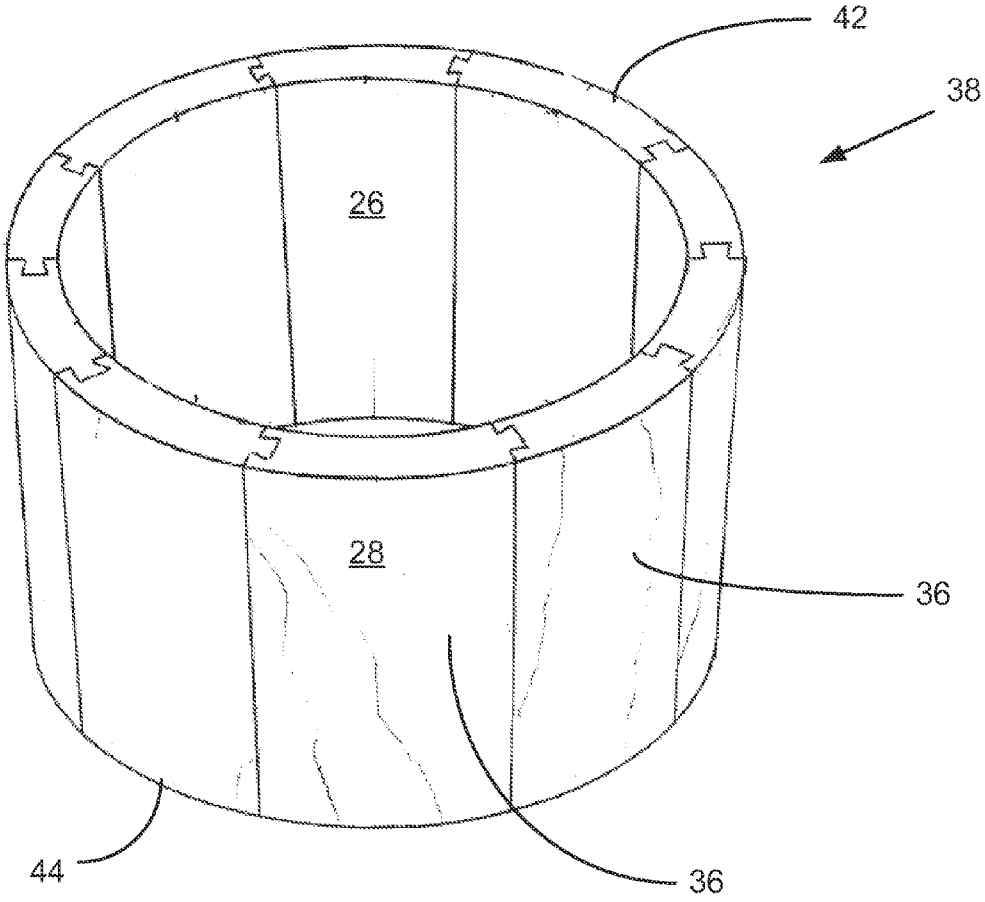
FIG. 3 is a perspective view of a cylinder formed by the staves of FIG. 2, which will become the cylinder of the drum of FIG. 1, before.

Referring to FIG. 2, the staves 12 are made by running lengths of wood 15 through a molding cutter of the type that is used to make crown molding and other types of moldings. The grain of the wood runs in the long direction of the length of wood. The knives of the molding cutter form radiused inner and outer surfaces 26, 28 respectively. As may be appreciated from FIGS. 2 and 3, the inner surface 26 is a concave surface, while the outer surface 28 is a convex surface. The radius of these surfaces dictates the diameter of the cylindrical body 13 that will be formed by the assembly of the plurality of staves 12, as shown in FIG. 3.

The length of wood 15 that has been run through the molding cutter now has a substantially constant cross-section along its entire length. The radius on the inner and outer surfaces 26, 26 of each stave 12 is such that the cylinder 38 formed by the assembled staves has a smooth, circular cross-section outer surface and a smooth, circular cross-section inner surface.

Figure 5:
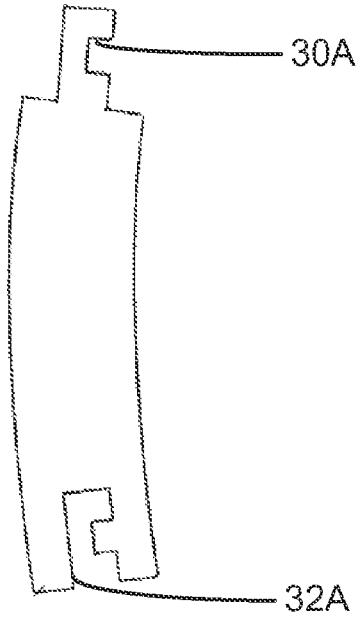
FIGS. 5, 6, and 7 are end views of alternate staves, showing alternate wood joinery profiles which may be used instead of the dove-tail profile shown in FIG. 2.
Figure 6:
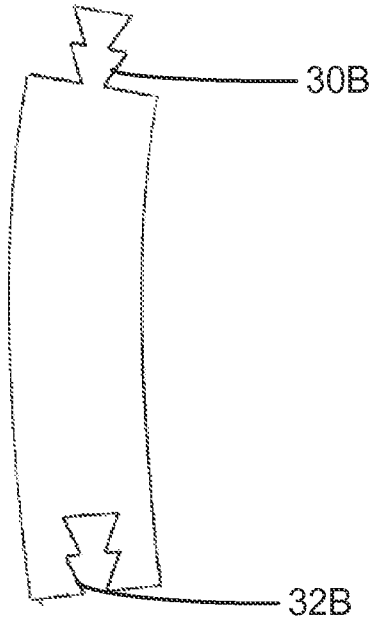
Figure 7:
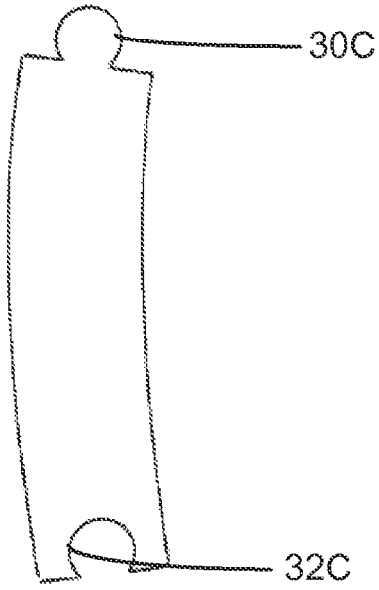

The molding cutter also cuts interlocking joinery profiles 30, 32 along the left and right side edges of the length of wood 15, as shown in FIG. 2. The embodiment of FIG. 2 shows interlocking joinery profiles 30, 32 in the form of sliding dove-tail joints. FIGS. 5-7 show possible alternate joinery profiles 30A, 32A (See FIG. 5); 30B, 32B (See FIG. 6); and 30C, 32C (See FIG. 7) which may also be used. Of course, other types of interlocking joinery profiles may also be used.

The left edge profile 32 of each vertical stave 36 cooperates with the right edge profile 30 of a next adjacent vertical stave 36 to form stave joints which mechanically interlock the staves 36 such that the stave joints allow the staves 36 to slide vertically relative to each other while preventing the staves 36 from separating from each other in the horizontal direction.

Once a long piece of wood 15 is run through the molding cutter (to form both the inner and outer surfaces 26, 28 and the joinery profiles on the left and right side edges 32, 30), it is then cut into pieces 36, as depicted by the broken line 34 in FIG. 2, with each piece having a length that corresponds to the height of the drum that is to be manufactured. Once enough vertical wood pieces 36 have been manufactured to make the drum 10, the left and right side edges of the pieces 36 are slid together in the vertical direction, connecting adjacent pieces to form a complete vertical cylinder 38 having a top edge 42 and a bottom edge 44, as shown in FIG. 3, with the grain of the wood running in the vertical direction.

Figure 4:
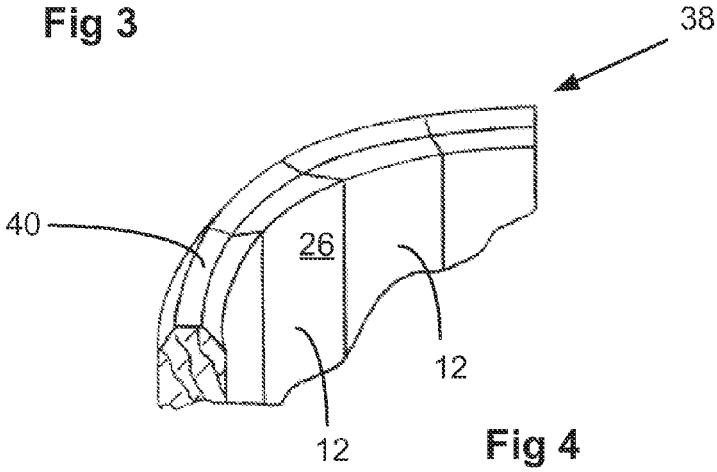
FIG. 4 is a broken-away perspective view, partially in section, showing a tapered profile that has been machined onto the top edge of the cylinder of FIG. 3, which is a mirror image of the tapered profile that is machined onto the bottom edge of the cylinder of FIG. 3.

Then a router or other tool is used to form a beveled edge 40 (See FIG. 4) at the top 42 and bottom 44 edges of the cylinder 38. The upper beveled edge 40 has a generally inverted "U" shaped profile, with a flat central portion that is tapered downwardly toward the inner and outer surfaces 26, 28, respectively. The bevel that is put on the bottom edge 44 has the same shape but is inverted, so that it has an upright "U" shaped profile.

The upper and lower hoops 14, 16 have a recess profile that matches the respective profiles that have been formed on the top and bottom edges 42, 44, so the top and bottom edges 42, 44 of the cylinder 38 are received in the recesses of the upper and lower hoops 14, 16, respectively, with the upper and lower heads 21 trapped between the hoops 14, 16 and the cylinder 38. Once the top and bottom hoops 14, 16 are secured in place by the tensioning rods 22, the vertical staves 12 are supported against movement inwardly, toward the axis of the cylinder 38, outwardly, away from the axis of the cylinder 38, and against vertical movement relative to each other.

The lugs 24 are evenly spaced around the circumference of the cylinder 38 at the midpoint of the height of the cylinder 38. In this embodiment, lugs 24 are installed on every other stave 12, as shown in FIG. 1. Finally, the top and bottom drum heads 21 and hoops 14, 16 are installed and secured with the tension rods 22.

This construction method (including the interlocking joinery profiles 30, 32 on the side edges of the staves and the beveled edges 40 on the top and bottom edges of the staves 12) eliminates the need for reinforcing hoops on the inside surface of the drum. It also should be noted that this construction method eliminates the need for glued joints to hold the staves together. In this preferred embodiment, the staves are held together by the mechanically interlocking joints 30, 32; they are not glued together.

A finish, such as polyurethane, may be applied to the staves 12 before they are assembled or after they are assembled, if desired.

It will be obvious to those skilled in the art that various modifications may be made to the embodiments described above without departing from the scope of the present invention as claimed.

What is claimed is:

1. A percussion drum, comprising:

a plurality of vertical staves, each vertical stave having top, bottom, left and right edges and inner and outer surfaces, wherein each of said left edges defines a left edge profile and each of said right edges defines a right edge profile, wherein the shape of the left edge profile of each vertical stave cooperates with the shape of the right edge profile of a next adjacent vertical stave to form stave joints which mechanically interlock the staves such that the stave joints allow the staves to slide vertically relative to each other while preventing the staves from separating from each other in the horizontal direction, wherein said mechanically interlocked adjacent staves form a vertical cylinder having a top cylinder edge and a bottom cylinder edge; and further comprising a top drum head and upper hoop mounted on the top cylinder edge, said top drum head including a thin sheet material which vibrates when hit to make a drum sound.

2. A percussion drum as recited in claim 1, wherein said stave joints are not glued.

3. A percussion drum as recited in claim 2, wherein said staves are made of wood and have a wood grain which runs in the vertical direction.

4. A percussion drum as recited in claim 3, wherein said left edge profile and said right edge profile form a dovetail joint.

5. A percussion drum as recited in claim 4, and further comprising a hoop mounted on the bottom cylinder edge.

6. A percussion drum as recited in claim 5, and further comprising a bottom drum head with a thin sheet material and a bottom hoop mounted on the bottom cylinder edge.

7. A method of manufacturing a percussion drum, comprising the steps of:

cutting a plurality of constant cross-section vertical staves, each having top, bottom, left and right edges and inner and outer surfaces;

assembling the staves together by sliding the edges of adjacent staves together in the vertical direction so the edges of adjacent staves interlock to prevent the staves from separating in the horizontal direction while still allowing the staves to slide relative to each other in the vertical direction;

wherein the assembled staves form a vertical cylinder having top and bottom cylinder edges;

installing top and bottom hoops on the top and bottom cylinder edges, and installing a drum head on at least one of the top and bottom cylinder edges.

8. A method of manufacturing a percussion drum as recited in claim 7, wherein the step of cutting the staves includes forming a radius on the inner and outer surfaces of each stave such that the cylinder formed by the assembled staves has a smooth, circular cross-section outer surface and a smooth, circular cross-section inner surface.

* * * * *